United States Patent [19]

Barlow

[11] Patent Number: 4,955,296

[45] Date of Patent: Sep. 11, 1990

[54] INCINERATOR GRATE ASSEMBLY

[76] Inventor: James L. Barlow, 2618 Somerville Ct., Ft. Collins, Colo. 80526

[21] Appl. No.: 278,183

[22] Filed: Dec. 1, 1988

[51] Int. Cl.[5] ..... F23H 3/00

[52] U.S. Cl. ..... 110/300; 110/257; 110/291

[58] Field of Search ..... 110/291, 289, 298, 299, 110/300, 255, 257, 259

[56] References Cited

U.S. PATENT DOCUMENTS

| | | | |
|---|---|---|---|
| 76,734 | 4/1868 | Fletcher | 110/298 |
| 654,774 | 7/1900 | Wood | 110/298 |
| 1,664,082 | 3/1928 | Mildon | 110/291 |
| 3,812,794 | 5/1974 | Taylor | 110/257 |
| 3,937,155 | 2/1976 | Kunstler | 110/255 |
| 4,473,013 | 9/1984 | John et al. | 110/291 |
| 4,510,873 | 4/1985 | Shigaki | 110/289 |
| 4,512,266 | 4/1985 | Shigaki | 110/291 |
| 4,676,176 | 6/1987 | Bonomelli | 110/291 |
| 4,732,561 | 3/1988 | Eiring et al. | 110/291 |

*Primary Examiner*—Edward G. Favors
*Assistant Examiner*—Denise L. Ferensic
*Attorney, Agent, or Firm*—Luke Santangelo

[57] ABSTRACT

A stationary, stepped, downwardly inclined incinerator grate assembly includes independent combustion control at each step through the provision of laterally disposed, perforated support tubes each joined to an inclined grate plate, likewise having openings therethrough. Valve devices associated with each support tube allow control of the volume of a mix gas which impinges upon a deposit of a feed material on the grate plates while damper elements in plenum chambers communicating with the apertured grate plates are controllable to regulate the admission of combustion air to the feed material.

10 Claims, 2 Drawing Sheets

INCINERATOR GRATE ASSEMBLY

FIELD OF THE INVENTION

The present invention relates generally to furnaces, and more particularly, to incinerator structure having an improved stoker grate for the burning of solid fuels, especially those fuels having widely varying combustion characteristics such as household refuse.

BACKGROUND OF THE INVENTION

Although this invention is primarily directed to an improved incinerator structure adapted to utilize solid fuel such as household and industrial waste, it will be understood that any of various types of combustible, particulate materials may serve as the supply fuel feed for the instant apparatus.

The difficulty of burning certain materials such as refuse is well-known. Refuse often includes a high percentage of slowburning or wet materials which impede combustion and exhibit an erratic burn rate. Furthermore, such compositions vary continuously with the weather, season, area where picked up, conditions under which stored and other uncontrollable and unpredictable variables.

One known method of burning refuse is to divide the incinerator grate into two or thee separate treatment zones and, through plenum chambers, provide combustion air under differing parameters to each one, thereby varying the characteristics of the air to suit the combustion needs. Thus, the air in the first zone containing fresh unburned refuse may be heated to dry out the trapped moisture, with combustion possibly not commencing until the refuse has entered the next zone, which is supplied with a different air mix.

Control of combustion in the various zones is generally limited to varying the characteristics of the air flowing to each zone. However, as the thickness of the refuse layer and its characteristics are generally not uniform across any one zone, burning time is longer, dictated by the slowest burning area on the grate.

It is, therefore, desirable to divide the grate surface into more zones and to provide means for independently controlling the combustion in each zone. Furthermore, the control should be as automatic as possible, so that each zone can be monitored and adjusted continuously, in an effort to maximize the efficiency of the burning to obtain the greatest throughput, be it solely an objective to dispose of an input feed material, or alternately to produce a source of energy, such as heated air, water or steam from the burning operation.

DESCRIPTION OF THE RELATED ART

The prior art burners and incinerators for combustion of solid fuels and particularly refuse, have recognized the nonhomogenous nature of many fuels, their high percentage of noncombustibles, and their changing combustion requirements as they proceed from the raw state upon grate entry to final ash form at discharge.

A variety of installations have been proposed to control the combustion airflow to effect better control of the combustion process. U.S. Pat. No. 2,072,450 illustrates the burning of finely-divided or crushed fuel Which is preheated on a sloping grate and traverses by gravity until blown upwards and backwards to assist in the burning of subsequently introduced fuel.

U.S. Pat. No. 3,334,599 discloses a furnace having separate grates for pre-drying and combustion of fuel using preheated air for drying and unheated air for combustion.

U.S. Pat. No. 3,651,770 discloses a mechanical grate which raises or agitates burning fuel to assure complete combustion.

U.S. Pat. No. 3,924,548 discloses an incinerator for refuse having a stationary grate provided with a plurality of combustion zones. individual wind boxes and controllable air supplies for each zone, whereby the fuel is agitated, lifted and transported by the combustion air.

However, nothing in the known prior art suggests the presently proposed construction for flowing both primary air and a secondary mix gas into the same combustion zone, the mix gas flow characteristics being controlled entirely separately from those of the primary, according to the existing combustion characteristics at each of a plurality of stepped grate zones or surfaces.

SUMMARY OF THE INVENTION

An object, advantage and feature of the invention is to provide a novel means to improve the speed of response and flexibility in the control of combustion of solid fuels on stationary, inclined, stepped incinerator grates by injecting a secondary mix gas into the fuel mass to lift and agitate it to cause fragmentation and faster flame propagation.

A further object of the invention is to provide secondary gas injection means for each of a plurality of orate steps with means to control the volume of this gas flow independently of each step.

Another object is to provide a plurality of ducts and flow control to accomplish the optimum combustion and migration of an input feed material with the independent control of each one of a plurality of adjacent grates, by remote and automatic means.

Still another object of the invention is to provide a stepped grate arrangement having a plurality of perforated support tubes transversely spanning the grate structure and serving both as a structural dam or step as Well as providing passageways for the flow of a mix gas supply.

A still further object is to position these support tubes projecting above adjacent inclined apertured grate plate surfaces to retain the fuel on the grate against the pull of gravity.

These, together with other objects and advantages of the invention, reside in the details of the process and the operation thereof as is more fully hereinafter described and claimed. References are made to drawings forming a part hereof, wherein like numerals refer to like parts throughout.

DESCRIPTION OF THE PREFERRED EMBODIMENT

Figure 1:
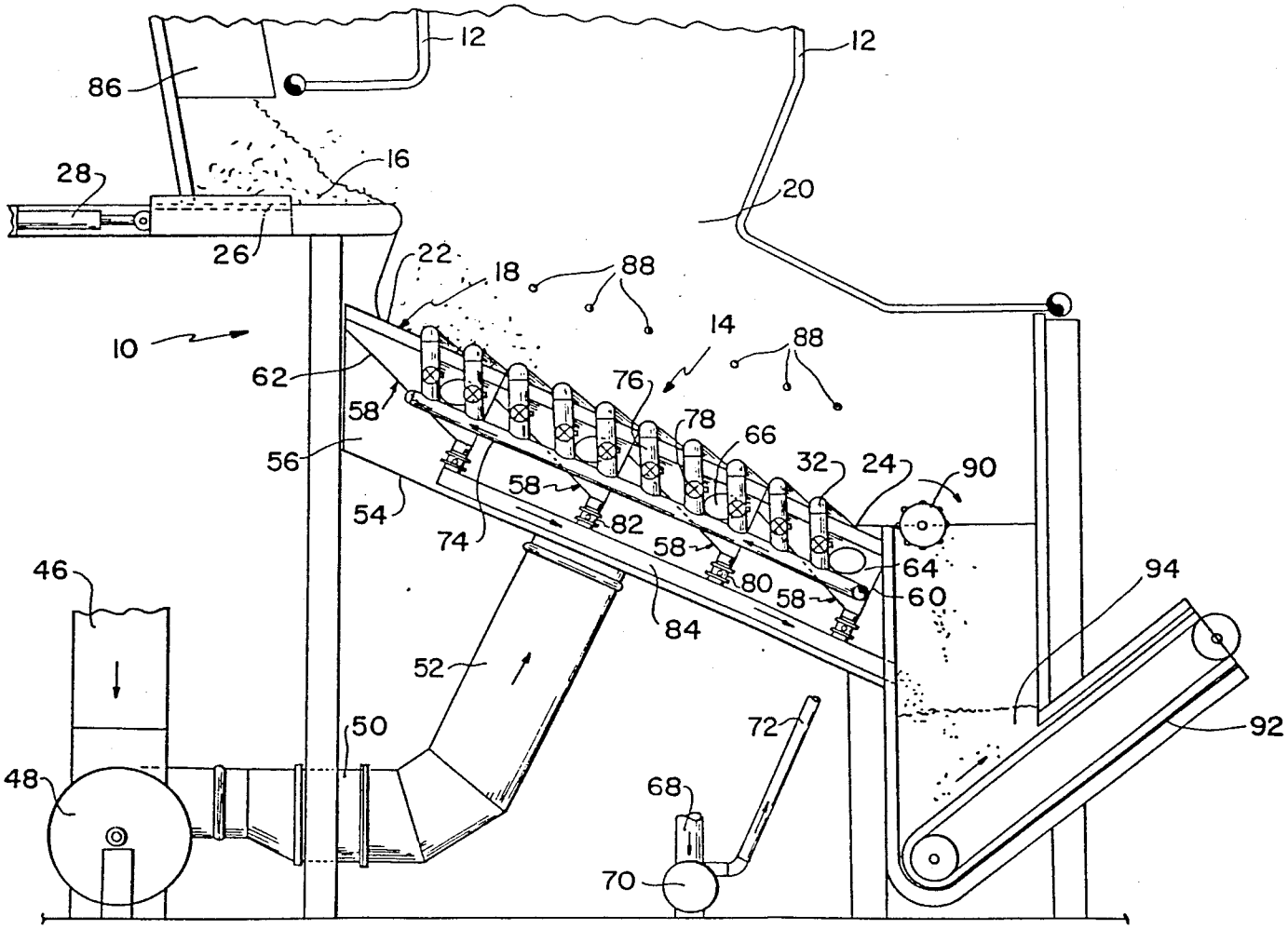
FIG. 1 is a side view illustrating the grate assembly according to the present invention.

Referring now to the drawings, particularly FIG. 1, the present invention will be seen to relate to a furnace or incinerator, generally designated by the numeral 10 and which may be employed for the primary purpose of merely incinerating an input feed product or, of utilizing an input feed to generate another source of energy, such as hot air, heated water or steam. In this respect, the peripheral housing or walls 12 of the furnace may be configured in any suitable well-known manner according to the intended use of the furnace.

Most specifically, the present invention is directed to the construction of the grate assembly 14 serving to receive and dispose of the fuel or feed material 16 to be subjected to combustion. This fuel may comprise any suitable material such as household or industrial refuse and which often will vary in its physical and chemical properties. An important advantage of the present apparatus is that numerous types of particulate, solid or semi-solid materials exhibiting a wide range of parameters, are readily accommodated by the instant grate assembly 14 with its attendant control system, such that optimum burning is achieved with minimum residue or ash remaining to be disposed of.

The grate assembly 14 will be seen to comprise an inclined upper table 18 spanning the breadth of the furnace chamber 20 and having its input feed end 22 mounted substantially above the elevation of a discharge end 24. The input end 22 is adapted to receive refuse or other feed material 16, as delivered by suitable apparatus, such as the feed table 26 associated with appropriate actuating means as reflected by the flow regulating device 28 in FIG. 1. With the feed table 26 positioned beneath a feed chute, it will follow that by regulating the operation of the cylinder 28 and its connected table 26, the volume of input feed material 16 delivered to the input end 22 of the grate table 18 may be controlled.

Figure 2:
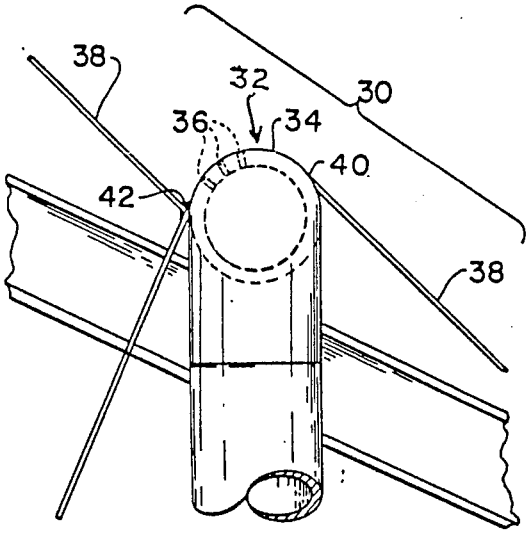
FIG. 2 is an enlarged end elevation of one end of a mix gas delivery tube.

Self-stoking of the feed material deposited upon the upper input end 22 of the fixedly mounted grate table 18 is achieved by a unique construction of the table and distribution of both combustion air and mix gas to the feed material thereon. The table 18 comprises a plurality of sequentially disposed grate segments 30, shown most clearly in FIGS. 2–3 and each including a transversely extending gas delivery tube 32 having a semicircular upper surface 34 provided with a plurality of mix gas supply nozzles or apertures 36 directed in a quadrant which is seen to be aimed in an upstream direction, with respect to the inclination of the grate assembly 14. Extending in a downstream direction from each tube 32 is a substantially planar grate plate 38 having an upper end 40 tangent to the constant radius curvature of the tube 32 and which is mounted at an inclination of approximately 45 degrees. The lower end 42 of the plate 38 is attached to the next lower gas delivery tube 32 at a level which is below its gas nozzles 36 such that an included angle of preferably less than 90 degrees is formed therewith. In this manner, a definite abutment will be seen to be formed at the lower end 42 of the grate plates 38 such that any feed material 16 received on any plate 38 will be at least initially retained thereupon.

Figure 3:
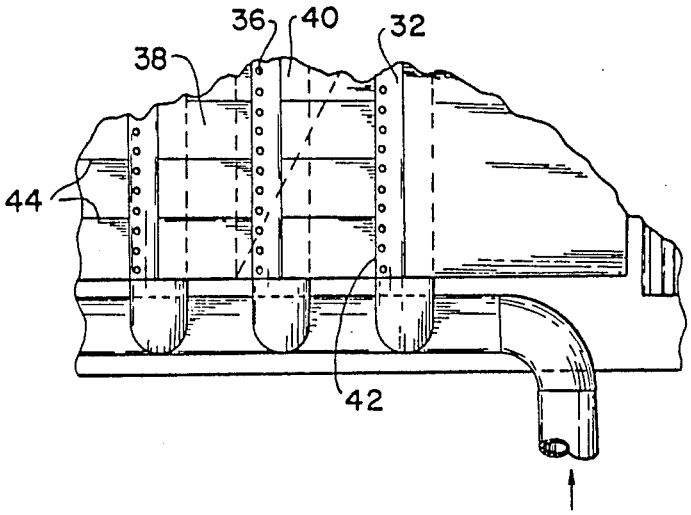
FIG. 3 is a fragmentary top plan of the grate assembly table.

As illustrated in FIG. 3, each grate plate 38 is provided with a plurality of apertures, preferably parallel, longitudinally extending slots 44 and which provide means for the release of combustion air into feed material on the grate plates. This air for supporting combustion is drawn from a furnace exterior source 46 by means of a controllable fan 48 and directed through a preheater 50 which may receive its heat from the very output generated by the stoker grate 14 of the invention. A combustion air duct 52 leads upwardly and through the bottom wall 54 of a main combustion air plenum 56 which will be seen to extend beneath the entire table 18 of the orate assembly. Mounted within the confines of the main plenum 56 are a plurality of adjacent, undergrate combustion air plenums 58, each enclosing the area beneath a plurality of grate segments 30. Each plenum 58 includes a depending front wall 60 and an inclined bottom wall 62 bounded by sidewalls 64,64. At least one controllable damper 66 in the Walls of each undergrate plenum 58 allows the regulated admission of combustion air from the primary supply plenum 56, which air is then directed upwardly through the plurality of grate plate slots 44 to support combustion atop the table 18 as will be described in detail hereinafter.

The gas utilized to aid and help control the burning of refuse contained upon the grate assembly 14 may be of any well-known type or mix thereof and will be referred to as the mix gas. This gas is received from a supply line 68 and forced by a controllable fan or blower 70 through a mix gas input line 72 to a mix gas supply header 74 extending longitudinally to serve all of the gas delivery tubes 32 as shown in FIGS. 1 and 3. A mix gas riser 76 provides communication between the header 74 and the end of each tube 32 and each riser will be seen to be provided with a suitable mix gas control valve 78. In this manner, the pressure and volume of mix gas as issuing from the nozzles 36 of any one of the delivery tubes 32 may be individually regulated.

The undergrate plenums 58 will be understood to serve a dual purpose. In addition to supplying combustion air through the slots 44 in the grate plates 38, smaller ash particles which may fall through these slots are directed to the lowest point within the respective plenums 56 and thence fall into an ash tube 80. This tube is provided with a controllable damper 82 allowing the regulated passage of ash siftings from the tube into a connected, common, inclined ash manifold duct 84.

With the above structure in mind, the operation of the grate assembly may now be described. Input feed 16, such as received from an appropriate input chute 86, is delivered to the feed table 26 whereafter it is directed, upon operation of the actuating means 28, to the elevated, input end 22 of the stoker grate table 18. With the combustion air fan 48 operating, input air is preheated at 50 and urged upwardly through the duct 52 and into the primary combustion air supply plenum 56. Combustion air is then directed, through the control dampers 66, into the respective undergrate plenums 58. At the same time, mix gas as forced into the supply header 74, is admitted into each of the delivery tubes 32 in accordance with the regulation of the respective control valves 78. This mix gas is thence issued from the plurality of upwardly and rearwardly facing nozzles 36 and combines with the combustion air issuing from the grate plate slots 44 to complete the requirements for ignition and the subsequent burning of the refuse or feed material 16.

During the above operation, as sequential charges of refuse are pushed onto the input end 22 of the orate table, this action forces refuse from the previously deposited charge to move downwardly over the steps or abutments presented by the elevated tubes 32. The inclination of the grate plates 38, which is greater than that of the grate assembly 14 itself, permits gravity to encourage a certain amount of downward progression of the burning feed charge. However, several factors Will affect the burn rate at each of the grate segments 30. The action of loading a fresh fuel charge materially alters the combustion requirements at each grate segment 30, as the fuel on each step will exhibit its own combustion requirements, and these parameters will change continuously as feeding and combustion proceeds. It will be appreciated that the volume, density and other characteristics of the charge at any one grate segment 30 will be constantly changing. Sensor means 88 of any suitable well-known type are appropriately positioned throughout the apparatus and serve to detect these changes, signaling the need for combustion air adjustments by regulation of the dampers 66, as well as regulation of the mix gas valves 78. Automatic stoking of the deposited feed material 16 and an optimum burn thereof will thus be understood to be precisely regulated in a manner leading to a vastly improved operation. The variable volume of issuance of the mix gas not only allows attainment of optimum combustion affecting the feed material but also enhances the progressive migration of the feed from one end of the grate table 18 to the other end. This will be apparent when it is realized that the pressure of the mix gas being directed from the plurality of tube nozzles 36 will lift up feed material overlying or upstream of those nozzles, thereby agitatinq, advancing and enhancing the burn thereof.

With proper regulation of the combustion air dampers 66 and mix gas valves 78, a maximum burn of the feed material is achieved before any of the feed can reach the discharge end 24 of the table. At this discharge end, only noncombustible material and ash that has not sifted through the grate plate slots 44 will be present and this material is delivered to a lowermost ash pit 94 by means of a driven ash discharge roller 90. An appropriate ash discharge conveyor 92 is thence operated to remove such unburned material from the ash pit 94 to a collection point external of the furnace wall 12. The ash pit 94 would be water-filled to provide a suitable seal between furnace wall 12 and the outside atmosphere.

It is to be understood that the present invention is not limited to the sole embodiment described above, but encompasses any and all embodiments within the scope of the following claims.

I claim:

1. An inclined grate assembly for the incineration of a feed material comprising:

a plurality of adjacent grate segments including at least one gas delivery tube having a plurality of apertures therethrough and wherein said gas delivery tube includes an upper surface with at least certain of said apertures projecting upstream of said inclined grate assembly, a downwardly inclined grate plate extending from said tube and including a plurality of openings therethrough, gas supply means joined to said gas delivery tubes and adapted to admit gas into said tubes and thence through said apertures, and said gas supply means including adjustable control means operable to regulate the volume of gas through said tube apertures, whereby upon manipulation of said control means, the effectiveness of the movement and burn of feed material atop said grate assembly may be maximized.

2. An inclined grate assembly according to claim 1 and further comprising a plenum means beneath said grate plates, said plenum means including adjustable control means operable to regulate the flow of combustion air through said plenum means and said grate plate openings.

3. An inclined grate assembly according to claim 1 wherein;

said plenum means includes a primary combustion air supply plenum defining an enlarged chamber beneath said grate segments, and a plurality of smaller undergrate combustion air plenums within said primary plenum each communicating with a plurality of said grate plates.

4. An inclined grate assembly according to claim 1 wherein;

said gas supply means includes a header pipe, a riser pipe communicating between each said gas delivery tube and said header pipe, and said gas supply control means including valves in said riser pipes.

5. An inclined grate assembly according to claim 1 wherein;

said grate plate openings comprise laterally spaced apart, longitudinally extending slots.

6. An inclined gate assembly according to claim 2 wherein;

each said grate plate extends substantially tangentially from one said tube upper surface.

7. An inclined grate assembly according to claim 3 wherein;

said plenum control means comprises an adjustable damper in each said undergrate plenum.

8. An inclined grate assembly according to claim 3 including;

an ash tube in each said undergrate plenum, and an inclined ash manifold duct connected to said ash tubes.

9. An inclined grate assembly according to claim 8 including;

damper means in said ash tubes.

10. An inclined grate assembly according to claim 6 wherein;

each said grate plate is inclined downwardly an amount greater than the inclination of the total grate assembly.

* * * * *